US007828497B2

(12) United States Patent
Boxberger

(10) Patent No.: US 7,828,497 B2
(45) Date of Patent: Nov. 9, 2010

(54) CONSTRUCTION AND DESIGN METHOD

(76) Inventor: Franklin Dale Boxberger, 10703 E. Pinnacle Peak Rd., Scottsdale, AZ (US) 85255

( * ) Notice: Subject to any disclaimer, the term of this patent is extended or adjusted under 35 U.S.C. 154(b) by 342 days.

(21) Appl. No.: 11/901,399

(22) Filed: Sep. 18, 2007

(65) Prior Publication Data

US 2009/0071094 A1 Mar. 19, 2009

(51) Int. Cl.
*E02D 29/02* (2006.01)

(52) U.S. Cl. ..... 405/287; 405/284; 405/286

(58) Field of Classification Search ..... 405/284, 405/286, 287; 52/741.12
See application file for complete search history.

(56) References Cited

U.S. PATENT DOCUMENTS

| | | | |
|---|---|---|---|
| 1,270,659 | A | 6/1918 | Ravier |
| 1,739,108 | A | 12/1929 | Weber |
| 1,747,038 | A | 2/1930 | Weber |
| 1,761,614 | A | 6/1930 | Collier |
| 1,762,343 | A | 6/1930 | Munster |
| 1,909,980 | A | 5/1933 | Newman |
| 1,933,483 | A | 10/1933 | Pennoyer |
| 2,000,492 | A | 5/1935 | McKeen |
| 2,045,112 | A | 6/1936 | Upson |
| 2,110,253 | A | 3/1938 | Nedden |
| 3,198,614 | A | 8/1965 | Powell |
| 3,226,933 | A | 1/1966 | White |
| 3,243,963 | A | 4/1966 | Schnabel, Jr. |
| 3,250,075 | A | 5/1966 | Webb et al. |
| 3,412,562 | A | 11/1968 | Doughty |
| 3,438,207 | A | 4/1969 | Turzillo |
| 3,464,211 | A | 9/1969 | Andresen |
| 3,490,242 | A | 1/1970 | Schnabel, Jr. |
| 3,530,676 | A | 9/1970 | York |
| 3,541,798 | A | 11/1970 | Schnabel, Jr. |
| 3,555,830 | A | 1/1971 | York |
| 3,638,435 | A | 2/1972 | Mason |
| 3,802,204 | A | 4/1974 | Mason |
| 3,807,182 | A | 4/1974 | Schnabel, Jr. |
| 3,922,864 | A | 12/1975 | Hilfiker et al. |
| RE28,977 | E | 9/1976 | Mason |
| 3,999,391 | A | 12/1976 | Meredith |
| 3,999,392 | A | 12/1976 | Fukushima et al. |
| 3,999,398 | A | 12/1976 | Kurose |
| 4,055,927 | A | 11/1977 | Tamaro |

(Continued)

FOREIGN PATENT DOCUMENTS

| | | |
|---|---|---|
| DE | 2917994 | 10/1980 |

(Continued)

*Primary Examiner*—David J Bagnell
*Assistant Examiner*—Sean D Andrish
(74) *Attorney, Agent, or Firm*—Stoneman Volk Patent Group; Martin L. Stoneman; Michael D. Volk, Jr.

(57) ABSTRACT

A retaining wall for supporting and stabilizing cut or fill areas of excavation and a method of constructing a retaining wall. The wall is preferably constructed by applying the concrete pneumatically. The method comprises installing a backing board while the vertical wall is pneumatically constructed. The backing board may be selectively removed after application of concrete. The footing and vertical wall can be constructed monolithically utilizing this method. This method of construction yields a high strength wall with very few construction steps and uses materials efficiently. The flexibility in the design and advantages regarding accessibility, along with needing fewer workers for construction, are also a large benefit.

22 Claims, 6 Drawing Sheets

U.S. PATENT DOCUMENTS

| | | | | |
|---|---|---|---|---|
| 4,106,225 | A | 8/1978 | Schnabel, Jr. | |
| 4,117,686 | A | 10/1978 | Hilfiker et al. | |
| 4,124,983 | A | 11/1978 | Weatherby | |
| 4,242,013 | A | 12/1980 | Watts | |
| 4,318,637 | A | 3/1982 | Oger et al. | |
| 4,343,572 | A | 8/1982 | Hilfiker et al. | |
| 4,369,004 | A | 1/1983 | Weatherby | |
| 4,391,557 | A | 7/1983 | Hilfiker et al. | |
| 4,407,611 | A | 10/1983 | Murray et al. | |
| 4,426,176 | A | 1/1984 | Terada | |
| 4,448,571 | A | 5/1984 | Eckels | |
| 4,449,857 | A | 5/1984 | Davis | |
| 4,470,728 | A | 9/1984 | Broadbent | |
| 4,480,945 | A | 11/1984 | Schnabel, Jr. | |
| 4,505,621 | A | 3/1985 | Hilfiker et al. | |
| 4,514,113 | A | 4/1985 | Neumann | |
| 4,548,153 | A * | 10/1985 | Watchorn | 114/267 |
| 4,561,804 | A | 12/1985 | Weatherby | |
| 4,564,316 | A | 1/1986 | Hunziker | |
| 4,718,791 | A | 1/1988 | Weatherby | |
| 4,718,792 | A | 1/1988 | Louis | |
| 4,732,510 | A | 3/1988 | Louis | |
| 4,911,582 | A | 3/1990 | Peirce, Jr. et al. | |
| 4,911,583 | A | 3/1990 | Carey | |
| 4,913,594 | A | 4/1990 | Jigourney | |
| 4,952,097 | A | 8/1990 | Kulchin | |
| 5,002,436 | A | 3/1991 | Sigourney | |
| 5,356,242 | A | 10/1994 | Elmore et al. | |
| 5,395,185 | A | 3/1995 | Schnabel, Jr. | |
| 6,598,613 | B2 | 7/2003 | Fritzche et al. | |
| 7,614,830 | B1 * | 11/2009 | Ritke | 405/286 |

FOREIGN PATENT DOCUMENTS

| | | | |
|---|---|---|---|
| FR | 2233857 | | 2/1975 |
| GB | 2102866 | | 2/1983 |
| WO | WO 91/05120 | * | 4/1991 |

* cited by examiner

CONSTRUCTION AND DESIGN METHOD

BACKGROUND

This invention relates to providing a system for improved pneumatically applied concrete retaining wall systems. More particularly, this invention relates to providing a system for the efficient construction of concrete retaining walls requiring very few construction steps.

Cast in place concrete walls require heavy materials to carry out the construction of the forms. An inexpensive and expeditious technique of constructing a concrete retaining wall would be of benefit to many.

OBJECTS AND FEATURES OF THE INVENTION

A primary object and feature of the present invention is to provide a system overcoming the above-mentioned problems.

It is a further object and feature of the present invention to provide such a system that yields a high strength wall with very few construction steps. It is another object and feature of the present invention to provide such a system that is efficient in the use of materials.

A further primary object and feature of the present invention is to provide such a system that is efficient, inexpensive, and useful. Other objects and features of this invention will become apparent with reference to the following descriptions.

SUMMARY OF THE INVENTION

In accordance with a preferred embodiment hereof, this invention provides a method of forming a retaining wall, usable to mechanically stabilize material to be retained, comprising the steps of: placing in position at least one upright wall reinforcing structure wherein the at least one upright wall reinforcing structure is supported from its base; placing at least one retaining wall backing support in an upright position to a first side of such at least one upright wall reinforcing structure; wherein the at least one upright wall reinforcing structure has sufficient apertures to allow passage of at least one sprayable cementitious material to fill spaces between the upright wall reinforcing structure and the at least one retaining wall backing support; spraying such at least one sprayable cementitious material through the at least one upright wall reinforcing structure onto the at least one retaining wall backing support; wherein such spraying continues until such at least one sprayable cementitious material encases the at least one upright concrete reinforcing structure; backfilling material to be retained against the concrete-encased at least one upright wall reinforcing structure.

Moreover, it provides such a method further comprising the steps of: prior to spraying such at least one sprayable cementitious material through the at least one upright wall reinforcing structure onto the at least one retaining wall backing support, securing such at least one retaining wall backing support to such at least one upright wall reinforcing structure using a plurality of supporting connectors; wherein such supporting connectors sufficiently space such at least one retaining wall backing support apart from such at least one upright wall reinforcing structure. Additionally, it provides such a method wherein such at least one sprayable cementitious material comprises pneumatically-placed concrete. Also, it provides such a method further comprising the step of installing at least one ground-supported footing structured and arranged to stably support the at least one upright wall reinforcing structure from its base. In addition, it provides such a method further comprising the step of: forming such at least one ground-supported footing concurrently with such retaining wall by the spraying of such at least one sprayable cementitious material; wherein such concurrent forming produces a unitary retaining wall structure comprising at least one ground-supported footing portion and at least one upright retaining wall portion.

And, it provides such a method further comprising the step of: placing such at least one ground-supported footing portion below an area intended to receive a backfill of the soil to be retained by such at least one upright retaining wall portion; wherein, when such area receives a backfill of the soil, such at least one upright retaining wall portion is restrained to resist overturning by a weight of the soil bearing on such at least one ground-supported footing portion. Further, it provides such a method wherein: the at least one retaining wall backing support defines at least one first wall surface of such at least one upright retaining wall portion; and the spraying of such at least one sprayable cementitious material to encase the at least one upright concrete reinforcing structure produces at least one second wall surface spaced apart from the at least one first wall surface. Even further, it provides such a method further comprising the step of positioning such at least one first wall surface adjacent such area intended to receive the backfill of the soil to be retained by such at least one upright retaining wall portion. Moreover, it provides such a method further comprising the step of positioning such at least one second wall surface adjacent the area intended to receive the backfill of the soil to be retained by such at least one upright retaining wall portion.

Additionally, it provides such a method wherein the at least one first wall surface and the at least one second wall surface are substantially parallel. Also, it provides such a method wherein: the at least one first wall surface and the at least one second wall surface are substantially non-parallel; and the distance between the at least one first wall surface and the at least one second wall surface increases concurrently with the depth of the soil retained by such at least one upright retaining wall portion. In addition, it provides such a method wherein such at least one upright wall reinforcing structure comprises an arrangement of steel reinforcing bars. And, it provides such a method wherein each such supporting connector of such plurality comprises a wire tie secured to the arrangement of steel reinforcing bars.

In accordance with another preferred embodiment hereof, this invention provides a method of forming a retaining wall, usable to mechanically stabilize material to be retained, comprising the steps of: providing upright wall reinforcing adjacent an area intended to contain the material to be retained to be stabilized; providing a ground-supported footing in a position below the area intended to contain the material to be retained to be stabilized; wherein the upright wall reinforcing and the ground-supported footing are structurally coupled; attaching to a first side of the upright wall reinforcing, and spaced at least one distance away from the upright wall reinforcing, at least one planar backing; pneumatically spraying through the upright wall reinforcing at least one sprayable cementitious material onto the at least one planar backing until the upright wall reinforcing is encased and at least one wall thickness is achieved; backfilling material to be retained against the concrete-encased at least one upright wall reinforcing structure.

Further, it provides such a method wherein the step of providing the ground-supported footing further comprises the step of: providing reinforcing for such at least one ground-supported footing; and forming such at least one ground-supported footing by pneumatically spraying the at least one sprayable cementitious material onto the reinforcing concurrently with the pneumatically spraying of the at least one sprayable cementitious material onto the at least one planar backing; wherein the upright wall reinforcing and reinforcing for at least one ground-supported footing are structurally coupled; and wherein the reinforcing for such at least one ground-supported footing is located in the position below the area intended to contain the soil to be stabilized. Even further, it provides such a method wherein such at least one sprayable cementitious material comprises pneumatically-placed concrete. Even further, it provides such a method further comprising the step of backfilling the area intended to contain the soil to be stabilized with the soil without removing the at least one planar backing. Even further, it provides such a method further comprising the step of stabilizing the upright wall reinforcing, during spraying of the at least one sprayable cementitious material, using bracing extending between the upright wall reinforcing and the ground.

In accordance with another preferred embodiment hereof, this invention provides a reinforcing system, facilitating the construction of at least one reinforced retaining wall using pneumatically-placed concrete, such reinforcing system comprising: at least one upright wall reinforcing structured and arranged to structurally reinforce at least one upright retaining wall portion of the at least one reinforced retaining wall; and attached to a first side of the at least one upright wall reinforcing, at least one planar backing spaced at least one distance away from the at least one upright wall reinforcing; wherein such at least one planar backing is structured and arranged to assist placement of the pneumatically-placed concrete by providing integral support of the pneumatically-placed concrete during placement of the pneumatically-placed concrete about the upright wall-reinforcing; and wherein such at least one planar backing is selectively removable. Even further, it provides such a reinforcing system further comprising a plurality of supporting connectors structured and arranged to support such at least one planar backing a predetermined distance from such at least one upright wall reinforcing. Even further, it provides such a reinforcing system wherein: such at least one upright wall reinforcing comprises an arrangement of steel reinforcing bars; and each such supporting connector of such plurality comprises a wire tie secured to the arrangement of steel reinforcing bars. Even further, it provides such a reinforcing system wherein such at least one planar backing comprises perforated pegboard. Even further, it provides such a reinforcing system further comprising: footing reinforcing structured and arranged to reinforce at least one footing portion of the at least one reinforced retaining wall; wherein such footing reinforcing is supportively coupled to such upright wall-reinforcing.

In accordance with another preferred embodiment hereof, this invention provides a method where forms are not required for the construction of a concrete (or any high compressive strength material) retaining walls, consisting of an inner and outer vertical face comprising the following steps: excavating a footing, installing rebar for the footing and the vertical wall (horizontal and vertical), then attaching a backing board or peg board to one side of the vertical wall rebar (leaving a minimum of a 2 inch gap). The concrete is then pneumatically applied against the peg board until the desired wall thickness is achieved. Even further, it provides a system not having two exterior forms as to enclose the inner and outer face of the vertical retaining wall.

In accordance with the preferred embodiments hereof, this invention provides a method comprising the further steps of: excavating earth for the footing, installation of all rebar for both the footing and the vertical wall, attaching the peg board or backing board to one side of the vertical portion of the retaining wall, pneumatically applying the concrete to the footing and against the-peg board as to construct the vertical wall. This method can be done in one step which allows the wall to be constructed monolithically. The footings do not have to be vertically stair stepped in 8" increments as traditional block, due to the pneumatically sprayed concrete being free formed and not being limited to block size or shape. The footings do not need to be vertically level, again due to pneumatically sprayed concrete not being limited to block size and laying block. The wall can be constructed utilizing a monolithic footing and vertical wall. Because this retaining wall does not have forms that will need to be removed, the wall footings and vertical portion of the retaining wall can be shot or constructed simultaneously, pneumatically sprayed, in one step. This will in turn result in a stronger wall than the traditional block retaining walls (cold joint between the footing and vertical retaining wall). The footing's shape on the horizontal or plan view section can be trapezoidal instead of stair stepping, again due to the limitation of block sizes. As the vertical height of the wall changes incrementally, the footing width can change along with the wall height maintaining a trapezoidal shape and thereby avoiding stair stepping the horizontal shape of the footing. The strength of the retaining wall can be changed by simply altering the strength of concrete. 3,000 psi or 4,000 psi concrete can easily be used, which far surpasses the standard strength of the standard concrete masonry unit (CMU), which is typically 1,500 psi. Because the concrete strength can be increased, a wall designed for 2,500 psi concrete can be constructed using 4,000 psi concrete and thereby allowing the wall to be backfilled earlier than a traditional retaining wall when the curing strength reaches said 2,500 psi. The vertical portion of the wall can avoid having a stair step effect. When standard block walls are constructed the walls may stair step from 16" to 12" to 8". Again this is due to the limitations of the block sizes. The vertical portion of the retaining wall can be shot with a sloping or battered face or back. This more accurately models the standard triangular load, which the backfilled soil, exerts on the vertical portion of retaining walls. Because of the lack of forms, the vertical portion of the retaining wall, as mentioned above, can be designed and constructed by using a "T" shape or any other shape as to achieve a more structurally sound wall or more aesthetically appealing wall. This wall, because it is pneumatically applied, can be constructed much quicker and with less labor or man hours required as that of the traditional retaining walls. This again is due to the fact that only one person is needed to apply the pneumatically sprayed concrete and one person to run the pump and trowel or finish the outside face of the vertical wall. This wall can be constructed in area that a block layer or mason may have difficulty with the accessibility. This would also include hauling the block and storing the block along with mixing or delivering the mortar and grout.

The pneumatically sprayed concrete allows one man and a concrete hose connected to a pump to access areas that would be otherwise be non-accessible. Materials can be saved because soil loads are triangular; therefore, there is no need for walls to be 8" thick on top. The load of the top of a retaining wall is 0 psi. Therefore the wall thickness at the top of the wall can be reduced to as little as 4" instead of the standard block wall of 8". Site walls can be constructed using this same method with the backing board being doubled up in the middle creating a hollow space in the center and thereby saving material. Vertical rebar spacing in the vertical wall can be spaced at the location that is most structurally and economically efficient. This rebar spacing will not be dependent on the location of the cells located within the block (i.e., every 8 inches).

DETAILED DESCRIPTION OF THE BEST MODES AND PREFERRED EMBODIMENTS OF THE INVENTION

Figure 1:
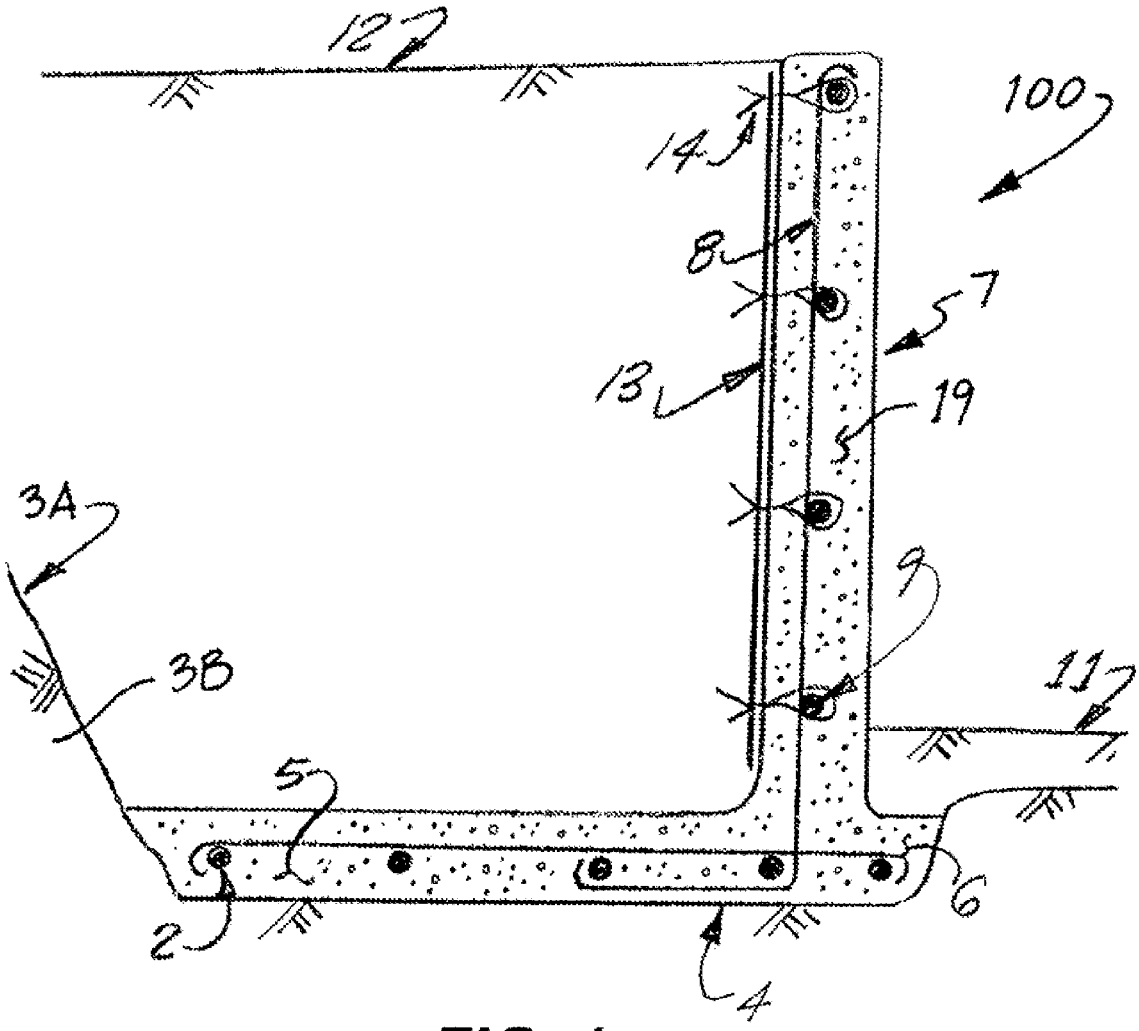
FIG. 1 shows a diagrammatic section view, through a vertical section of a pneumatically sprayed concrete retaining wall, according to a preferred embodiment of the present invention.
Figure 2:
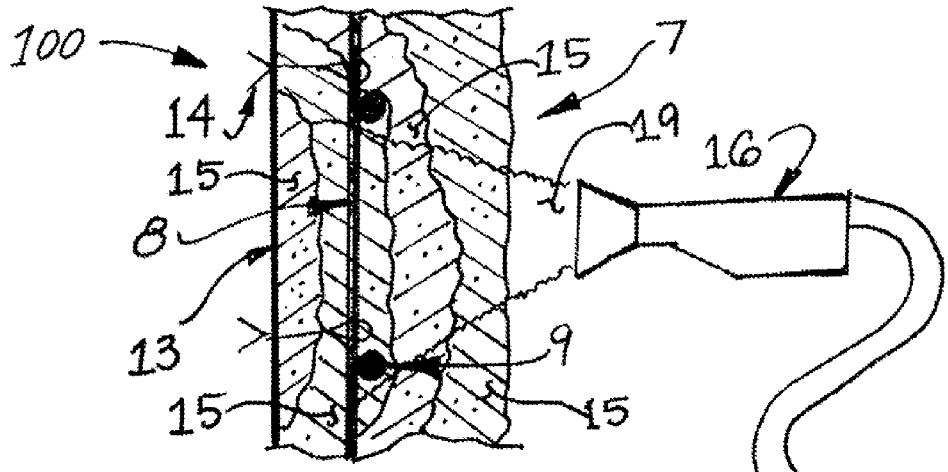
FIG. 2 shows a partial section view, through a portion of the pneumatically sprayed concrete retaining wall of FIG. 1, diagrammatically illustrating the formation of the pneumatically sprayed concrete retaining wall through the application of pneumatically sprayed concrete, according to a preferred embodiment of the present invention.

FIG. 1 shows a diagrammatic section view, through a vertical section of a pneumatically sprayed concrete retaining wall 100, according to a preferred embodiment of the present invention. FIG. 2 shows a partial section view, through a portion of the pneumatically sprayed concrete retaining wall 100 of FIG. 1, diagrammatically illustrating the formation of the pneumatically sprayed concrete retaining wall 100 through the application of pneumatically sprayed concrete 19, according to a preferred embodiment of the present invention.

The footing 4 of the pneumatically sprayed concrete retaining wall 100 can be "sprayed in" pneumatically, as shown in FIG. 2. The horizontal rebar 2 is required for lateral strength in the footing 4. The cut 3A in the soil 3B provides for temporary access and for the footing requirements and should be stable. The base of the footing 4, before concrete is shot or poured in, should be stable and have a minimum specified friction and soil bearing capacity, per the final design specifications. The heel 5, which is the portion of the footing 4 (at least embodying herein at least one ground-supported footing) that will be under the bulk of the back fill 12 (that is, below the area intended to contain backfilled soil to be stabilized), will hold the pneumatically sprayed concrete retaining wall 100 from overturning, sliding or subsiding. The toe 6 also assists in preventing overturning or subsiding of the retaining wall.

The vertical retaining wall portion 7 of the pneumatically sprayed concrete retaining wall 100 also comprises pneumatically sprayed concrete 19 (shotcrete, gunite). Shotcrete and gunite are two commonly used terms for cementitious materials applied pneumatically via pressure hoses. This vertical retaining wall portion 7 is preferably applied or sprayed at the same time as the footing 4 and thereby creates a monolithically constructed retaining wall. The vertical rebar 8 is preferably hooked and supported by using both the horizontal rebar 2 in the proposed footing 4 and the horizontal rebar 9 in the vertical retaining wall portion 7. This horizontal rebar 9 is used to temporarily stabilize the vertical rebar 8 until the pneumatically applied concrete 19 (shotcrete) can be applied. Upon reading this specification, those with ordinary skill in the art will now appreciate that, the term "rebar" is a common abbreviation of the term "reinforcing bar". The horizontal bars in both the footing 4 and the vertical retaining wall portion 7 of the pneumatically sprayed concrete retaining wall 100 are needed not only for the rigidity of the rebar wall until the pneumatically sprayed concrete 19 is applied, but it is also required for the overall horizontal strength that both members (footing and vertical wall) require. The above-described vertical rebar 8 and the horizontal rebar 9 together embody herein at least one upright wall reinforcing structure.

The temporary backing board 13 is then attached to the vertical rebar 8 using a plurality of supportive fasteners 14, as shown, preferably in the form of wires or tiebacks, as shown. The backing board 13 can be made of any flat (and thus will be a planar backing) material as long as it is spaced and tied approximately 2 inches or more away from the vertical rebar 8 to prevent rust and or corrosion in the future. The plurality of supportive fasteners 14 act as a spacer to space the backing board from the vertical rebar. (The above arrangement at least embodying herein providing a plurality of backing supports structured and arranged to support such at least one retaining wall backing support from such at least one upright wall reinforcing structure, wherein each backing support of such plurality comprises at least one spacer to space such at least one retaining wall backing support apart from such at least one upright wall reinforcing structure). The backing board 13 is most preferably ¼ inch peg board that is light weight and has holes drilled approximately 1" to 2" on center in both directions (horizontally and vertically). This peg board (backing board 13) is preferably removed when the pneumatically sprayed concrete 19 has set, or alternately preferably, it can be left in place. If the backing board 13 is left in place, the back fill 12 or earth can be placed against the board. Leaving the board in place is an option, and has no structural affect on the pneumatically sprayed concrete retaining wall 100.

As illustrated in FIG. 2, the pneumatically applied concrete 19 is preferably shot from the gun 16, through the spaced-apart openings (apertures) between the rebar (vertical rebar 8 and horizontal rebar 9), from the opposite side of the backing board 13. The pneumatically sprayed concrete 19 is preferably applied in layers 15 so that there will not be too much force or weight against the backing board 13 at any given time. The application of the concrete in this fashion (pneumatically) is what allows this method of retaining wall construction to be carried out. This method is unlike cast-in-place concrete walls that require heavy materials to carry out the construction of the forms. It is a simple, inexpensive, and expeditious technique of constructing a concrete retaining wall. The pneumatically sprayed concrete 19 is delivered by a pump 18 through a hose 17 out of the gun 16, as shown. The strength of the retaining wall can be changed by simply altering the strength of concrete. 3,000 pound per square inch (psi) or 4,000 psi concrete can be used to construct the disclosed embodiments. Because the concrete strength can be increased, a wall designed for 2,500 psi concrete can be constructed using 4,000 psi concrete, thereby allowing the wall to be backfilled earlier than a traditional retaining wall, when the curing strength reaches said 2,500 psi.

The pneumatically-placed retaining wall embodiments of the present invention can be constructed much quicker and with less labor or man hours required in comparison to traditional retaining walls. This again is due to the fact that only one person is needed to apply the pneumatically sprayed concrete and one person to run the pump and trowel or finish the outside face of the vertical wall. The pneumatically-placed retaining wall embodiments of the present invention can be constructed in an area that a block layer or mason may have difficulty with the accessibility. This would also include hauling the block and storing the block along with mixing or delivering the mortar and grout. The pneumatically sprayed concrete allows one man and a concrete hose connected to a pump to access areas that would be otherwise be non-accessible places.

Figure 3:
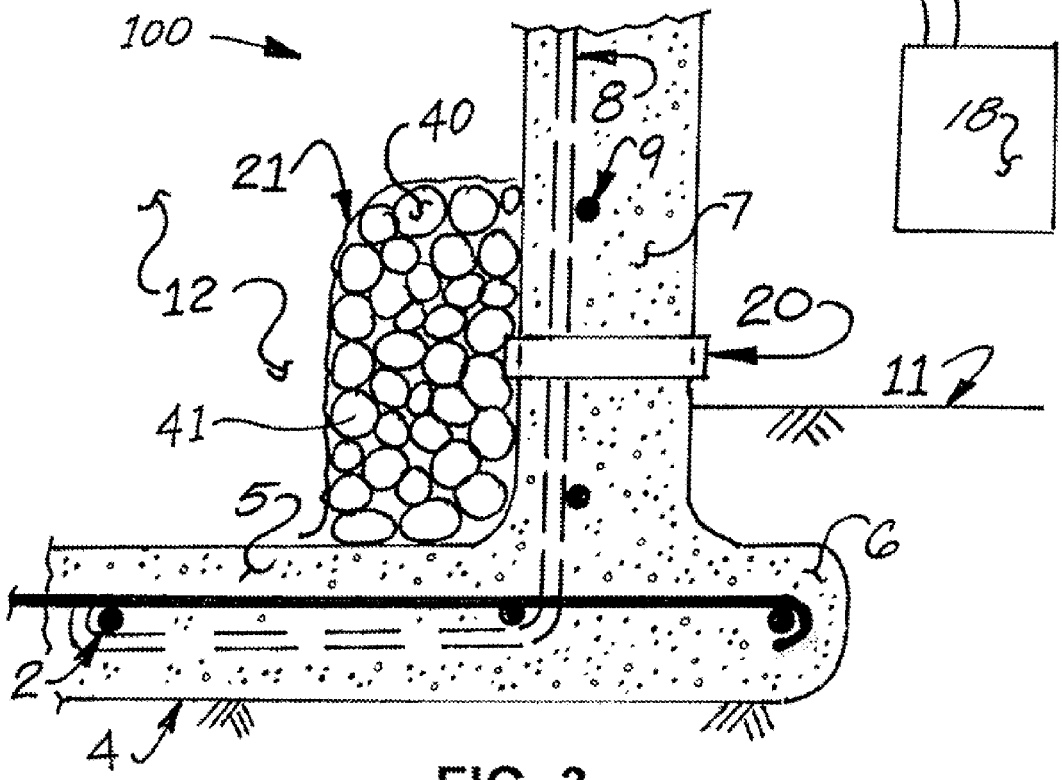
FIG. 3 shows a partial section view, through a lower portion of the pneumatically sprayed concrete retaining wall of FIG. 1, diagrammatically illustrating a first preferred means for relieving hydrostatic pressure from behind the pneumatically sprayed concrete retaining wall, according to a preferred embodiment of the present invention.

FIG. 3 shows a partial section view, through a lower portion of the pneumatically sprayed concrete retaining wall 100 of FIG. 1, diagrammatically illustrating a first preferred means for relieving hydrostatic pressure from behind the retaining wall, according to a preferred embodiment of the present invention. Hydrostatic pressure is preferably relieved behind the retaining wall in the same fashion as the conventional block retaining wall. This can be achieved by placing 2" to 3" diameter polyvinyl chloride (PVC) pipe 20 every 6 foot on center just above the outside finished grade 11, as shown. The back fill 12 at the back side of the wall preferably comprises a continuous horizontal rock pocket 40 preferably comprising river rock or equal consisting of 1" to 2" rounded river rock 41. In addition to this a filter fabric 21 can be installed if required. This filter fabric keeps the soil fines from entering the voids of the river rock (weep rock) and thereby allowing the hydrostatic pressure to be relieved more effectively.

Figure 4:
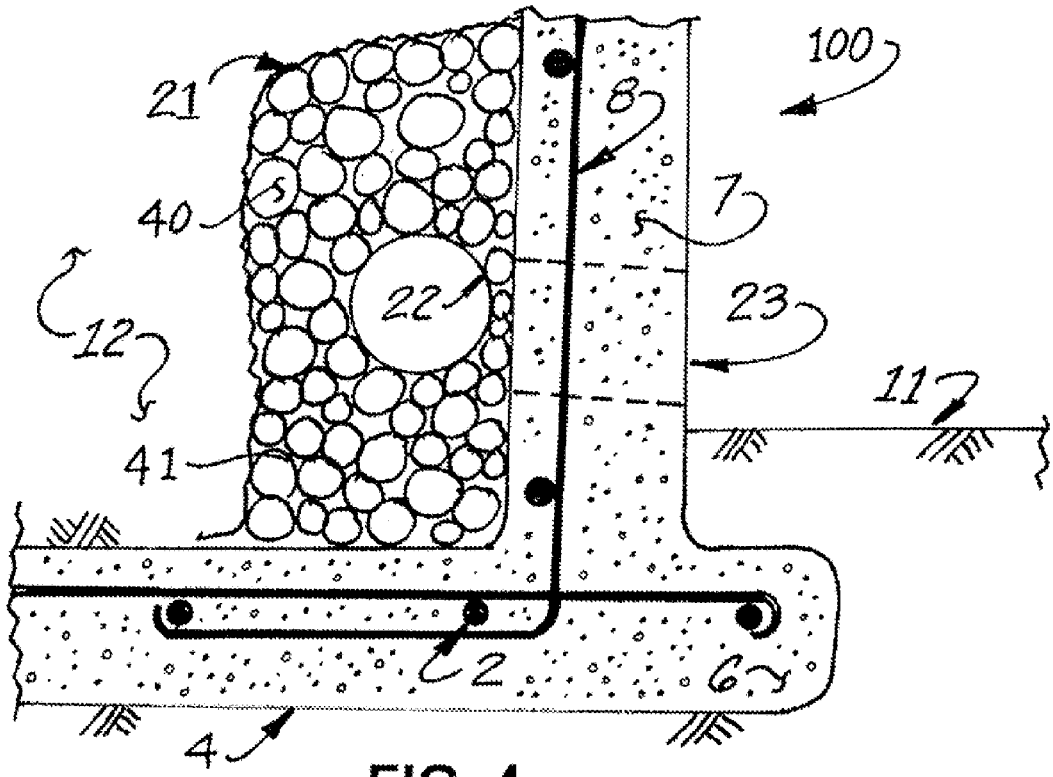
FIG. 4 shows a partial diagrammatic section view, through a lower portion of the pneumatically sprayed concrete retaining wall of FIG. 1, illustrating a second preferred means for relieving hydrostatic pressure from behind the pneumatically sprayed concrete retaining wall, according to a preferred embodiment of the present invention.

FIG. 4 shows a partial diagrammatic section view, through a lower portion of the pneumatically sprayed concrete retaining wall 100 of FIG. 1, illustrating a second preferred means for relieving hydrostatic pressure from behind the retaining wall, according to a preferred embodiment of the present invention. Other methods of relieving hydrostatic pressure can also be used: such as a 4" perforated drain pipe 22 (see FIG. 4) running parallel to the footing 4 with river rock 41 (weep rock and filter fabric) and eventually day lighting or gravity flowing out to a lower elevation 23, as shown.

Figure 5:
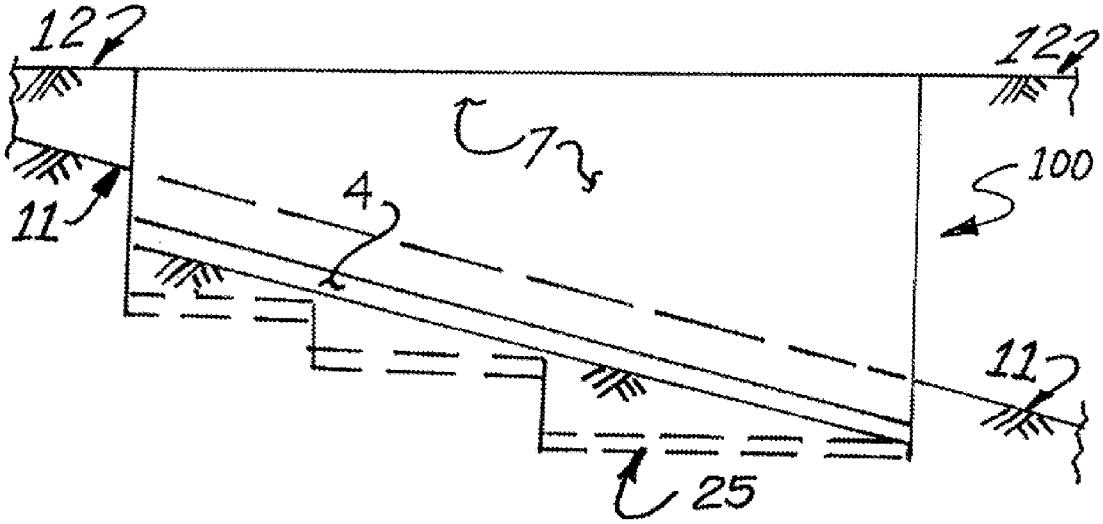
FIG. 5 shows an elevation view, diagrammatically illustrating the preferred elimination of stair stepping in a footing of the pneumatically sprayed concrete retaining wall, according to a preferred embodiment of the present invention.
Figure 6:
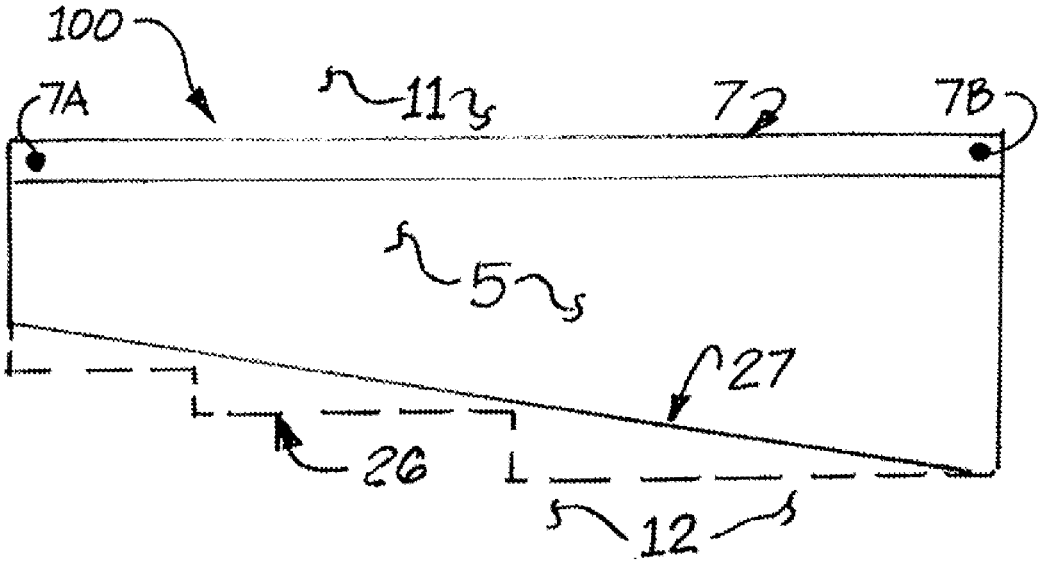
FIG. 6 shows a plan view, diagrammatically illustrating the footing configuration of a variable height retaining wall, according to a preferred embodiment of the present invention.

FIG. 5 shows an elevation view, diagrammatically illustrating the preferred elimination of stair stepping in a footing 4 of the pneumatically sprayed concrete retaining wall 100, according to a preferred embodiment of the present invention. FIG. 6 shows a plan view, diagrammatically illustrating the footing configuration of a variable height retaining wall, according to a preferred embodiment of the present invention. The footings 4, when excavated, do not have to be vertically stair stepped 25, as indicated by the dashed line depiction. Because this is a pneumatically shot concrete retaining wall, there is no need for level footings stepped vertically in 8" increments to accommodate for the block size used in the traditional block walls. The footing 4 can simply be excavated to the specified depth below the lower finished grade 11 (See also FIG. 1) uniformly following the existing grade. This will save time and materials associated with excavating, concrete, and other material costs. The plan view, as shown in FIG. 6, shows that a retaining wall may change in vertical height (for instance, going from a 3 foot vertical height at point 7A to a 9 foot vertical height at point 7B). The footing 4 can make a smooth linear width transition 27 instead of the stair stepping configuration 26 (illustrated by the dashed line depiction) commonly used in traditional block and concrete retaining walls. The vertical retaining wall portion 7 of this retaining wall can also be constructed with a batter or slope (See FIG. 7).

Figure 7:
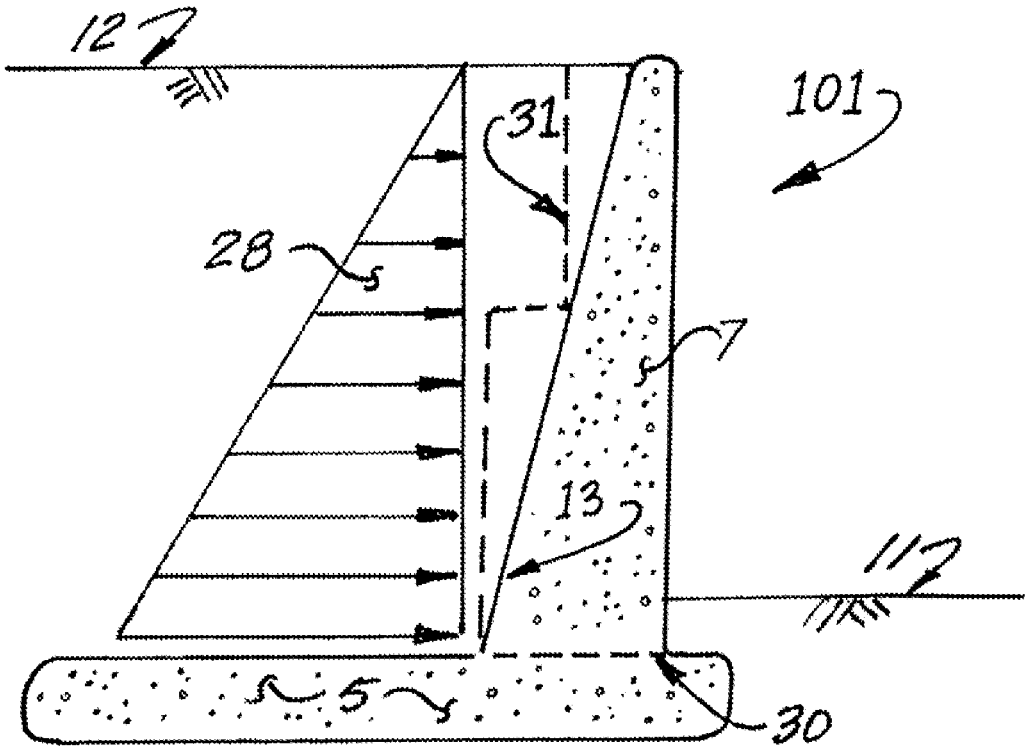
FIG. 7 shows a diagrammatic section view, through a vertical section of a battered pneumatically sprayed concrete retaining wall, according to another preferred embodiment of the present invention.

FIG. 7 shows a diagrammatic section view, through a vertical section of a battered pneumatically sprayed concrete retaining wall 101, according to another preferred embodiment of the present invention. Because the back fill 12 (soil or earth) exerts a triangular load 28 on the vertical portion of the battered pneumatically sprayed concrete retaining wall 101, resulting in a zero load at the top and a large load at the bottom: a battered design is the most structurally effective and cost efficient method to construct his portion of the retaining wall. It is noted that traditional block walls must stair step 31, as indicated by the dashed-line depiction. Again, stair stepping is an inefficient use of material and adds additional un-needed costs.

The preferred pneumatically applied concrete retaining wall embodiments of the present invention can be constructed in two concrete phases (the footing and vertical wall), much like in the traditional block and concrete retaining wall construction methods. However, the pneumatically constructed retaining wall can also be constructed monolithically by pneumatically applying the concrete, for the footing 4 and the vertical retaining wall portion 7, in one step. This method preferably eliminates a cold joint 30, as shown in FIG. 7. This retaining wall yields a higher strength, when constructed monolithically. A block wall by its nature cannot be built monolithically FIG. 8 shows a top view, of a "T" beam shaped pneumatically sprayed concrete retaining wall 102, according to another preferred embodiment of the present invention.

Figure 8:
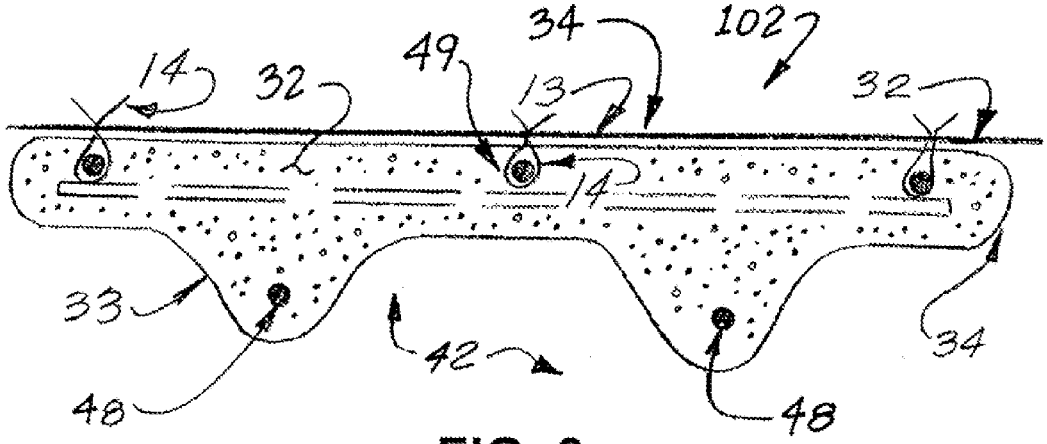
FIG. 8 shows a top view, of a "T" beam shaped pneumatically sprayed concrete retaining wall, according to another preferred embodiment of the present invention.
Figure 9:
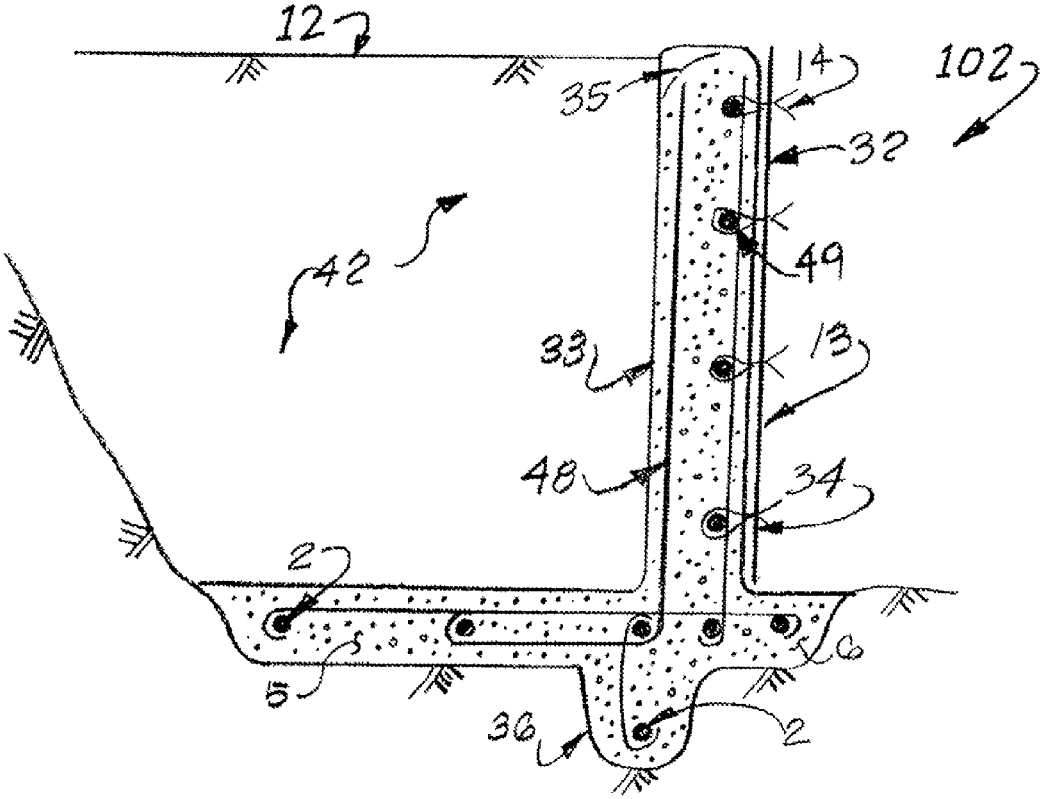
FIG. 9 shows the sectional view 9-9 of FIG. 8, according to the alternate preferred embodiment of FIG. 8.

FIG. 9 shows the sectional view 9-9 of FIG. 8, according to the alternate preferred embodiment of FIG. 8. Because the retaining wall embodiments of the present invention do not utilize conventional forms, more efficient cross sectional shapes can be achieved in the design and construction. One such shape of the vertical wall cross section preferably comprises a "T" beam shape, as shown. In this case, the backing board 13 is preferably attached to the outer rebar 49 opposite the fill side 42), as shown. The rebar 48 preferably comprises structural steel designed to withstand the tension exerted on the wall. The other rebar 49 in the vertical retaining wall portion 32 is mainly needed to attach and stabilize the backing board 13 attached with fasteners 14 while the shotcrete or pneumatic concrete is being applied. After the first phase of concrete has been shot at side 34, the second phase can then be applied or constructed at side 33, as shown. This "T" Beam arrangement preferably results in a more effective use of the concrete material. Since the backfill or soil load is negligible at the top of the vertical retaining wall portion 32, a taper 35 can be constructed at the top, as shown. This is preferably used to create a more aesthetically appealing wall at the top after the backfilling with back fill 12 has occurred.

Alternately, a key 36 can also be constructed in the footing. This key would, in some cases, allow the footing 50 to be reduced in size. This key 36 helps decrease the sliding factor of the overall retaining wall.

Figure 10:
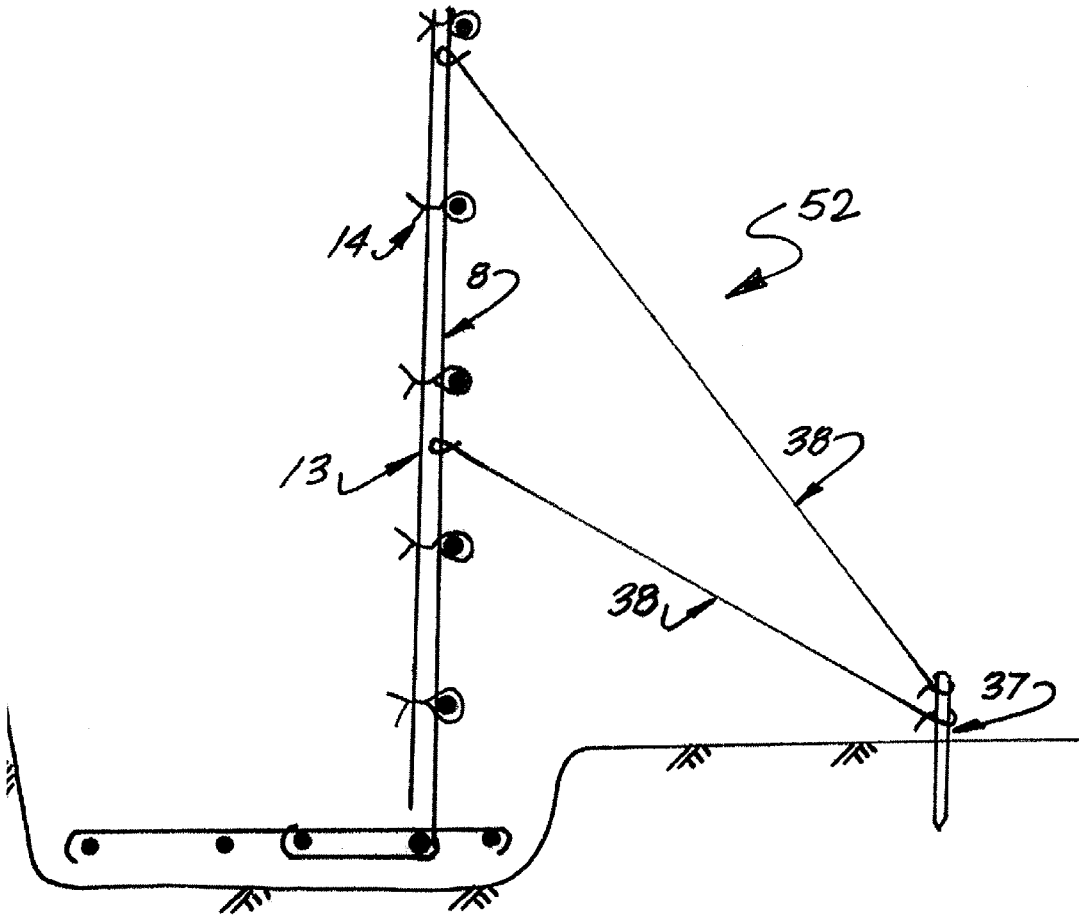
FIG. 10 shows a schematic diagram illustrating a preferred means for providing temporary bracing during the construction of the pneumatically sprayed concrete retaining walls of the present invention.

FIG. 10 shows a schematic diagram illustrating a preferred means for providing temporary bracing 52 during the construction of the preferred pneumatically sprayed concrete retaining wall embodiments of the present invention. As some of these walls increase in vertical height, the need for additional bracing may be required. This temporary bracing 52 can be accomplished by installing temporary guy wires 38. The guy wires 38 are preferably attached to the vertical rebar 8 and stabilized by a stake 37 (pole, post rebar) secured in the ground as to stabilize the guy wire 38 and the vertical rebar 8. This method is required in the cases when the vertical rigidity is required to stabilize the backing board 13 and rebar when applying the pneumatically applied concrete 19. These guy wires 38 are cut and removed after the shotcrete or concrete has started to cure. The stakes 37 can also be removed at that same time.

The above-described method of retaining wall construction can, under appropriate circumstances, accommodate or incorporate a variety of footing shapes and designs. For instance, "L" shape footings, reverse footings (backfill on the opposite side), footings with a turn downs or key downs, or even areas where no footings are required (for instance, bedrock or other existing solid materials). The footing, for this method of retaining wall construction, can also be constructed with a traditional poured in place footing or any other type or style of footing.

This method of retaining wall construction can, under appropriate circumstances, have many alternate cross sectional shapes. For instance "T" shape, waffle shape, corrugated or other structural or aesthetically pleasing arrangements. Site walls can be constructed using this same method with the backing board being doubled up in the middle creating a hollow space in the center and thereby saving material.

Under appropriate circumstances, the pneumatically applied concrete walls described herein can have a substitution of alternate material. For instance, the rebar as noted in this design can be substituted with any material that yields a tensile strength (i.e., Carbon Fiber, graphite, metals, alloys, etc.). The pneumatically applied or sprayed on concrete can, under appropriate circumstances, also be substituted by using any material which yields a high compressive strength (i.e., Mortar, gunnite, glues, epoxies, etc.).

The design and construction of this retaining wall allows the vertical rebar to be sized and spaced where best suited structurally and economically. The spacing is not dependant on cell locations as with Masonry or CMU (Concrete Masonry Unit) Blocks.

Although applicant has described applicant's preferred embodiments of this invention, many other advantages of applicant's invention will be apparent to those skilled in the art from the above descriptions and the below claims.

I claim:

1. A method of forming a retaining wall, usable to mechanically stabilize material to be retained, comprising the steps of:

a) placing in position at least one upright wall reinforcing structure wherein the at least one upright wall reinforcing structure is supported from its base;

b) placing at least one retaining wall backing support in an upright position to a first side of such at least one upright wall reinforcing structure;

c) wherein the at least one upright wall reinforcing structure has apertures to allow passage of at least one sprayable cementitious material to fill spaces between the upright wall reinforcing structure and the at least one retaining wall backing support;

d) spraying such at least one sprayable cementitious material through the at least one upright wall reinforcing structure onto the at least one retaining wall backing support;

e) wherein such spraying continues until such at least one sprayable cementitious material encases the at least one upright wall reinforcing structure;

f) after such spraying is completed, selectively removing the at least one retaining wall backing support and then backfilling material to be retained against either the concrete-encased at least one upright wall reinforcing structure or the at least one retaining wall backing support.

2. The method according to claim 1 further comprising the steps of:

a) prior to spraying such at least one sprayable cementitious material through the at least one upright wall reinforcing structure onto the at least one retaining wall backing support, securing such at least one retaining wall backing support to such at least one upright wall reinforcing structure using a plurality of supporting connectors;

b) wherein such supporting connectors space such at least one retaining wall backing support apart from such at least one upright wall reinforcing structure.

3. The method according to claim 2 wherein such at least one upright wall reinforcing structure comprises an arrangement of steel reinforcing bars.

4. The method according to claim 3 wherein each such supporting connector of such plurality comprises a wire tie secured to the arrangement of steel reinforcing bars.

5. The method according to claim 1 wherein such at least one sprayable cementitious material comprises pneumatically-placed concrete.

6. The method according to claim 1 further comprising the step of installing at least one ground-supported footing structured and arranged to support the at least one upright wall reinforcing structure from its base.

7. The method according to claim 6 further comprising the step of:

a) forming such at least one ground-supported footing concurrently with such retaining wall by the spraying of such at least one sprayable cementitious material;

b) wherein such concurrent forming produces a unitary retaining wall structure comprising at least one ground-supported footing portion and at least one upright retaining wall portion.

8. The method according to claim 7 further comprising the step of:

a) placing such at least one ground-supported footing portion below an area intended to receive a backfill of the soil to be retained by such at least one upright retaining wall portion;

b) wherein, when such area receives a backfill of the soil, such at least one upright retaining wall portion is restrained to resist overturning by a weight of the soil bearing on such at least one ground-supported footing portion.

9. The method according to claim 8 wherein:

a) the at least one retaining wall backing support defines at least one first wall surface of such at least one upright retaining wall portion; and b) the spraying of such at least one sprayable cementitious material to encase the at least one upright wall reinforcing structure produces at least one second wall surface spaced apart from the at least one first wall surface.

10. The method according to claim 9 further comprising the step of positioning such at least one first wall surface adjacent such area intended to receive the backfill of the soil to be retained by such at least one upright retaining wall portion.

11. The method according to claim 9 further comprising the step of positioning such at least one second wall surface adjacent the area intended to receive the backfill of the soil to be retained by such at least one upright retaining wall portion.

12. The method according to claim 9 wherein the at least one first wall surface and the at least one second wall surface are substantially parallel.

13. The method according to claim 9 wherein:

a) the at least one first wall surface and the at least one second wall surface are substantially non-parallel; and b) the distance between the at least one first wall surface and the at least one second wall surface increases concurrently with the depth of the soil retained by such at least one upright retaining wall portion.

14. A method of forming a retaining wall, usable to mechanically stabilize material to be retained, comprising the steps of:

a) providing upright wall reinforcing adjacent an area intended to contain the material to be retained to be stabilized;

b) providing a ground-supported footing in a position below the area intended to contain the material to be retained to be stabilized;

c) wherein the upright wall reinforcing and the ground-supported footing are structurally coupled;

d) attaching to a first side of the upright wall reinforcing, and spaced at least one distance away from the upright wall reinforcing, at least one planar backing;

e) pneumatically spraying through the upright wall reinforcing at least one sprayable cementitious material onto the at least one planar backing until the upright wall reinforcing is encased and at least one wall thickness is achieved;

f) after spraying is completed, selectively removing the at least one planar backing and then backfilling material to be retained against either the concrete-encased at least one upright wall reinforcing structure or the at least one planar backing.

15. The method according to claim 14 wherein the step of providing the ground-supported footing further comprises the step of:

a) providing reinforcing for such at least one ground-supported footing; and b) forming such at least one ground-supported footing by pneumatically spraying the at least one sprayable cementitious material onto the reinforcing concurrently with the pneumatically spraying of the at least one sprayable cementitious material onto the at least one planar backing;

c) wherein the upright wall reinforcing and reinforcing for at least one ground-supported footing are structurally coupled; and d) wherein the reinforcing for such at least one ground-supported footing is located in the position below the area intended to contain the soil to be stabilized.

16. The method according to claim 15 wherein such at least one sprayable cementitious material comprises pneumatically-placed concrete.

17. The method according to claim 15 further comprising the step of backfilling the area intended to contain the soil to be stabilized with the soil without removing the at least one planar backing.

18. The method according to claim 15 further comprising the step of stabilizing the upright wall reinforcing, during spraying of the at least one sprayable cementitious material, using bracing extending between the upright wall reinforcing and the ground.

19. A reinforcing system, facilitating the construction of at least one reinforced retaining wall using pneumatically-placed concrete, said reinforcing system comprising:

a) at least one upright wall reinforcing structured and arranged to structurally reinforce at least one upright retaining wall portion of the at least one reinforced retaining wall; and b) attached to a first side of the at least one upright wall reinforcing, at least one planar backing spaced at least one distance away from the at least one upright wall reinforcing;

c) wherein said at least one planar backing is structured and arranged to assist placement of the pneumatically-placed concrete by providing integral support of the pneumatically-placed concrete during placement of the pneumatically-placed concrete about the upright wall-reinforcing; and d) wherein said at least one planar backing is selectively removable after placement of the pneumatically-placed concrete about the upright wall-reinforcing and prior to use of said reinforcing system as at least one retaining wall.

20. The reinforcing system according to claim 19 further comprising a plurality of supporting connectors structured and arranged to support said at least one planar backing a predetermined distance from said at least one upright wall reinforcing.

21. The reinforcing system according to claim 20 wherein:

a) said at least one upright wall reinforcing comprises an arrangement of steel reinforcing bars; and b) each said supporting connector of said plurality comprises a wire tie secured to the arrangement of steel reinforcing bars.

22. The reinforcing system according to claim 20 further comprising:

a) footing reinforcing structured and arranged to reinforce at least one footing portion of the at least one reinforced retaining wall;

b) wherein said footing reinforcing is supportively coupled to said upright wall-reinforcing.

* * * * *